US007021622B2

(12) United States Patent
Carter et al.

(10) Patent No.: US 7,021,622 B2
(45) Date of Patent: Apr. 4, 2006

(54) IMAGE FORMING DEVICE HAVING A SENSOR WITH TWO SEPARATE DISTINGUISHABLE TRIGGERS

(75) Inventors: Daniel L. Carter, Georgetown, KY (US); Edward Lawrence Kiely, Lexington, KY (US); John William Kietzman, Lexington, KY (US); Edward A. Rush, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 169 days.

(21) Appl. No.: 10/639,297

(22) Filed: Aug. 12, 2003

(65) Prior Publication Data

US 2005/0051949 A1 Mar. 10, 2005

(51) Int. Cl.
*B65H 7/02* (2006.01)

(52) U.S. Cl. ..... 271/258.01; 271/262; 271/265.01

(58) Field of Classification Search ..... 271/258.01, 271/262, 263, 265.01, 265.04
See application file for complete search history.

(56) References Cited

U.S. PATENT DOCUMENTS

| | | | | |
|---|---|---|---|---|
| 4,228,996 | A | 10/1980 | Wilcox, Jr. | |
| 4,300,758 | A | 11/1981 | Peter, III | |
| 4,699,365 | A | 10/1987 | Smith et al. | |
| 4,793,605 | A | 12/1988 | Tajima | |
| 4,901,117 | A | 2/1990 | Derrick | |
| 4,979,727 | A | 12/1990 | Koike et al. | |
| 4,986,529 | A | 1/1991 | Agarwal et al. | |
| 4,998,716 | A | 3/1991 | Okumura et al. | |
| 5,042,790 | A | 8/1991 | Miller et al. | |
| 5,093,690 | A | 3/1992 | Ohno et al. | |
| 5,153,663 | A | 10/1992 | Bober et al. | |
| 5,201,518 | A | 4/1993 | Isoda | |
| 5,234,213 | A | 8/1993 | Chen | |
| 5,263,708 | A | 11/1993 | Hacknauer | |
| 5,539,510 | A | 7/1996 | Yamashiro et al. | |
| 5,590,872 | A | 1/1997 | Oominami et al. | |
| 5,882,130 | A | 3/1999 | Kumazaki et al. | |
| 5,964,460 | A | 10/1999 | Azumi et al. | |
| 5,974,298 | A | 10/1999 | Urban et al. | |
| 6,032,949 | A | 3/2000 | Ando | |
| 6,032,950 | A | 3/2000 | Ikeda | |
| 6,152,443 | A | 11/2000 | Claramunt et al. | |
| 6,247,695 | B1 * | 6/2001 | Linder et al. | 271/265.04 |
| 6,290,410 | B1 | 9/2001 | Sunada et al. | |
| 2004/0135311 | A1 * | 7/2004 | Chambers et al. | 271/265.01 |

* cited by examiner

*Primary Examiner*—David H. Bollinger
(74) *Attorney, Agent, or Firm*—Coats & Bennett, PLLC

(57) ABSTRACT

The present invention is directed to a device having an arm and a sensor that can differentiate two events. The arm is pivotally mounted to move in different directions upon the occurrence of different events. A section of the arm includes a trigger section having an unequal distribution of a sensed characteristic. A first event moves the arm in a first direction that is sensed by the sensor in a first manner. A second event moves the arm in a second direction that is sensed by the sensor in a second manner. The sensor signals a controller that oversees the image forming process. Methods of operating the arm and sensor are disclosed for detecting the two separate events, and signaling the controller accordingly.

22 Claims, 7 Drawing Sheets

IMAGE FORMING DEVICE HAVING A SENSOR WITH TWO SEPARATE DISTINGUISHABLE TRIGGERS

BACKGROUND

Image forming devices place an image on a media sheet thus producing an imaged output. The image forming device includes a media path for moving the media sheet and receiving the toner image. The media path may include a first path for forming a toner image on a first side of the media sheet, and a second path for forming an image on a second side of the media sheet.

The image forming device also include doors which open and close to allow access to the media path. The doors allow for media jams to be accessed and removed without disassembling the image forming device.

Previous image forming devices use multiple devices for sensing and directing the media sheets. In one prior device, a first sensor was used to sense a media sheet moving into a first predetermined area of the media path. A second sensor indicated the media sheet entering into a second predetermined area of the media path. Further, a diverter was positioned to direct sheets between the first path and second path depending upon whether imaging occurred on both sides of the media sheet. Additionally, another sensor indicated whether the access door was in an open or closed orientation. Thus, four separate sensing and directing devices were used within the image forming device.

Price is often a driving factor weighed by consumers when purchasing an image forming device. Often times, price is the primary requirement in the purchasing decision, with other machine parameters being of secondary importance. Therefore, design implementations with several different operations performed by a single element are advantageous. The multi-functional element is a less-expensive alternative. As always, quality of the formed images should not be degraded by the multi-functional element.

SUMMARY

The present invention is directed to a device that can distinguish between two separate events that are occurring to the image forming device. A first event causes the device to move in a first manner that is sensed in a first way. A second event causes the device to move in a second manner that is sensed in a second way. Therefore, a single device is able to differentiate between two separate events that occur to the image forming device.

In one embodiment, the device includes an arm and a sensor. The arm is pivotally mounted within the image forming device and includes a first end and a second end. A first section is positioned to be contacted upon the occurrence of the events, and a second section is positioned to be sensed by the sensor. The sensor is positioned adjacent to the second section and includes a first area having a first sensed characteristic, and a second area having a second sensed characteristic. The first event causes the arm to move in a first manner with the first sensed characteristic being sensed by the sensor. The second event causes the arm to move in a second manner with the second sensed characteristic being sensed by the sensor.

In one embodiment, the different sensed characteristics include openings positioned within the arm. The sensed characteristics may also include other characteristics that can be differentiated including capacitance, magnetism, thickness, reflectance, and others. The second section of the arm may be positioned at a second end opposite the first section, or at various other locations along the arm. In one embodiment, the first section is detected by the sensor.

DETAILED DESCRIPTION

Figure 1:
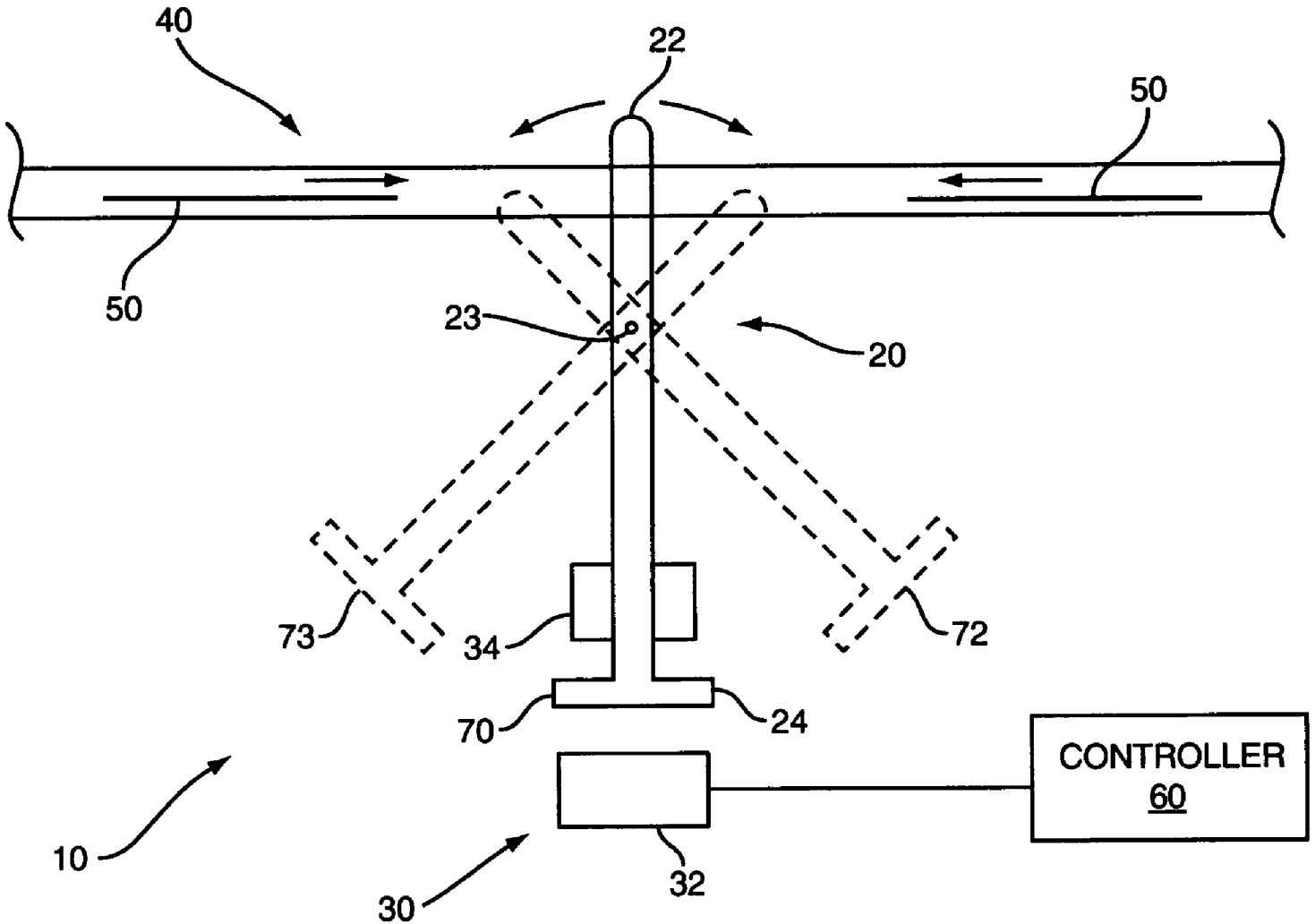
FIG. 1 is a side view of a moving arm positioned adjacent to a media path and having a sensor to detect movement of the arm according to one embodiment of the present invention.

The present invention is directed to a device, generally illustrated as 10 in FIG. 1, having an arm 20 and sensor 30 that can differentiate two events within an image forming device. The arm 20 is pivotally mounted to move in different directions upon the occurrence of different events. A section 24 of the arm 20 includes a trigger section having an unequal distribution of a sensed characteristic. A first event moves the arm 20 in a first direction that is sensed by sensor 30 in a first manner. A second event moves the arm 20 in a second direction that is sensed by sensor 30 in a second manner. The sensor 30 signals a controller 60 that oversees the image forming process.

Arm 20 includes a first end 22, second end 24, and a pivot 23 as illustrated in FIG. 1. The arm 20 is positionable between a first position 70, second position 72, and third position 73. In the first position 70, the first end 22 extends into the media path 40. The arm 20 may be sized to extend completely across the media path 40, or just partially. The first position 70 is a "home" position that the arm 20 assumes when no events are occurring. The first position may be attained by the weighting of the arm 20, or a biasing mechanism (not illustrated) that urges the arm 20 towards this position.

Pivot 23 is positioned along the length of the arm 20. The pivot 23 may be positioned at a variety of points between the first end 22 and second end 24.

Figure 2:
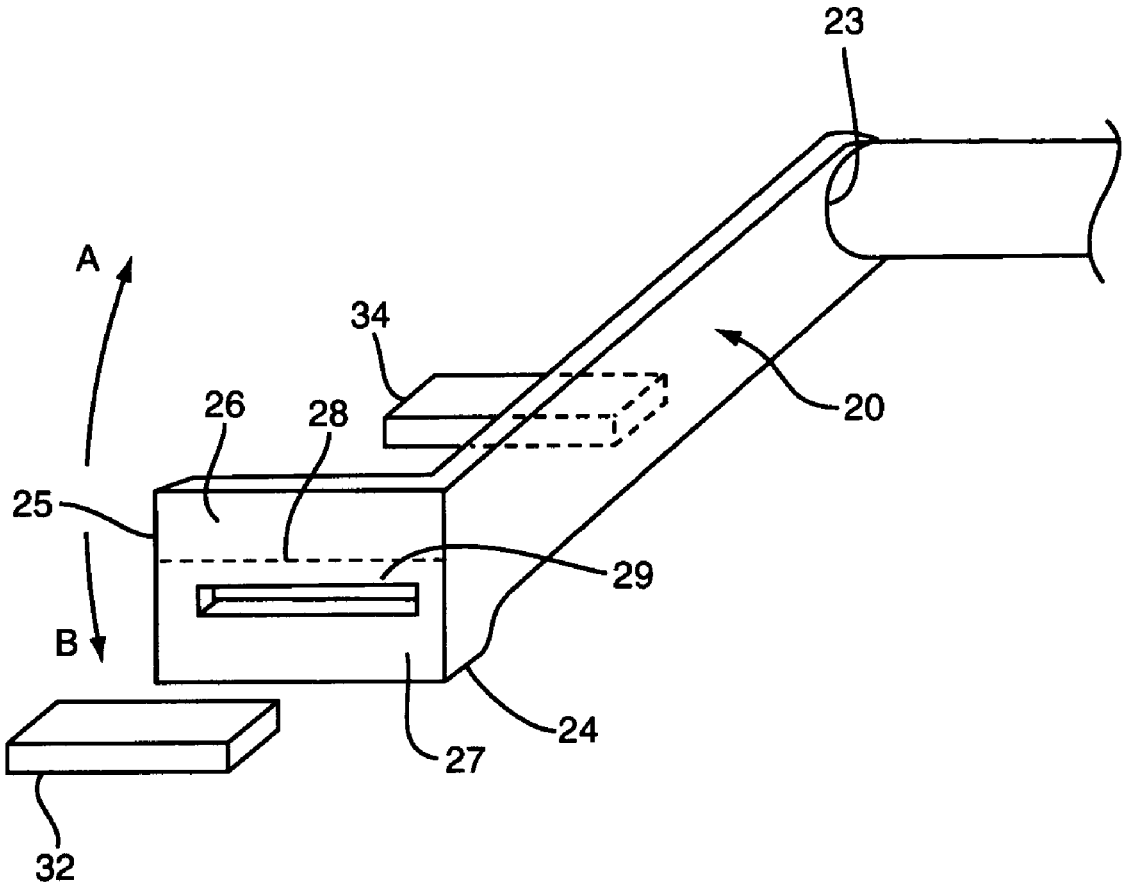
FIG. 2 is a partial perspective view of the arm having a trigger section that moves between the sensor according to one embodiment of the present invention.

Second end 24 is located on an opposite side of the pivot 23 from the first end 22. FIG. 2 illustrates one embodiment of the second end 24 having a trigger section 25 that moves between the sensor 30. Trigger section 25 is divided into a first section 26 and a second section 27 by a reference line 28. Reference line 28 may be positioned at a variety of locations along the trigger section 25. In one embodiment, the reference line 28 is a centerline that equally divides the trigger section 25.

The first section 26 and second section 27 have different characteristics that are sensed and differentiated by the sensor 30. In the embodiment of FIG. 2, the first section 26 is a solid section, and the second section 27 includes an opening 29. The opening 29 creates a different transmittance characteristic in the second section 27 that can be sensed and differentiated from the first section 26. In the embodiment of FIG. 2, sensor 30 comprises a light beam transmitter 32 that emits a light beam that is received by a receiver 34. When the arm 20 is in the first position (i.e., no events are occurring), the trigger section 25 is positioned between the transmitter 32 and receiver 34.

In one embodiment, the reference line 28 is centered between the transmitter 32 and receiver 34 when the arm 20 is in the first position 70. When a first event occurs and the arm 20 is moved from the first position 70 to the second position 72, the first section 26 moves across the light beam. When a second event occurs and the arm 20 is moved from the first position 70 to the third position 73, the second section 27 moves across the light beam.

Figure 3A:
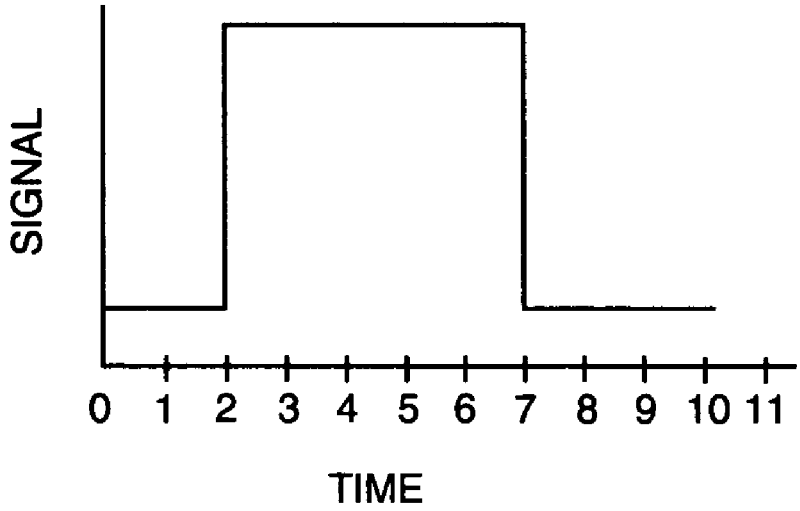
FIG. 3A is a graph of a detection signal for a first event according to one embodiment of the present invention.

FIG. 3A illustrates the detection signal resulting from the arm 20 moving from the first position 70 to the second position 72 (i.e., first section 26 moving across the light beam) and then moving back to the first position 70. When the arm 20 is in the first position 70, the light beam is blocked resulting in the output being low at time 0. As the first event occurs, the arm 20 begins moving towards the second position with the edge of the first section 26 moving beyond the beam at time 2. At time 2, the light beam is no longer blocked and the output signal is high. The arm 20 remains in the second position 72 until the end of the first event. The arm 20 then returns towards the first position 70. In the example of FIG. 3A, the first event ends at time 5, and the arm 20 moves from the second position 72 towards the first position 70. The arm 20 does not block the light beam until time 7 as it returns towards the first position 70 resulting in the output being again low.

Figure 3B:
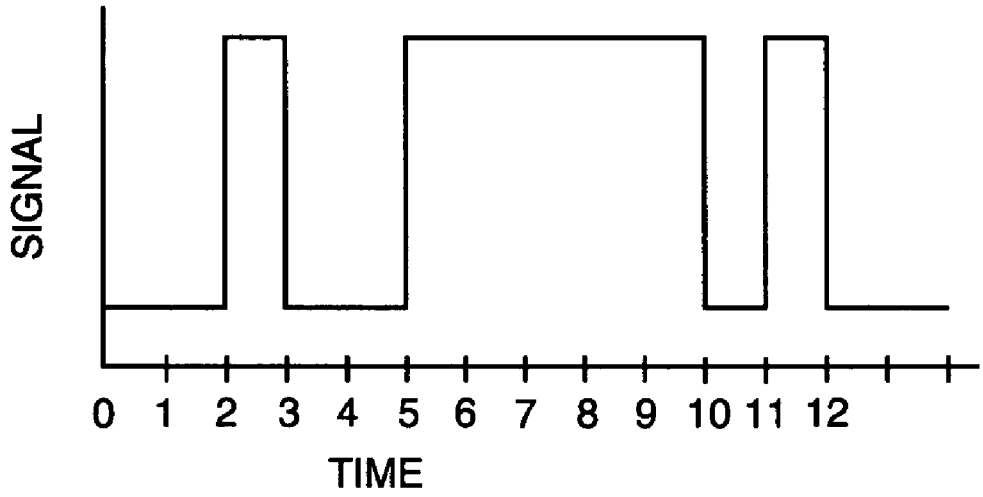
FIG. 3B is a graph of a detection signal for a second event according to another embodiment of the present invention.

FIG. 3B illustrates the detection signal resulting from the arm 20 moving from the first position 70 to the third position 73 (i.e., second section 27 moving across the light beam). The light beam is blocked when the arm is in the first position 70 as indicated at time 0. As the arm 20 begins to move at the beginning of the second event, the opening 29 moves through the light beam at time 2 and the output becomes high. The arm 20 moves towards the third position 73 with the light beam remaining in the opening from time 2 through time 3, and then is again blocked by the remaining portion of the second section 27. The arm 20 then moves a distance such that the second section 27 clears the light beam at time 5. The arm 20 remains clear of the light beam until the event is complete at time 8. The arm 20 then moves back towards the first position 70 and the small section blocks the light beam from time 10 through time 11. The signal is again high from time 11 through time 12 as the opening 29 again moves through the light beam. Finally, the output is low as the light beam is again blocked.

Figure 4:
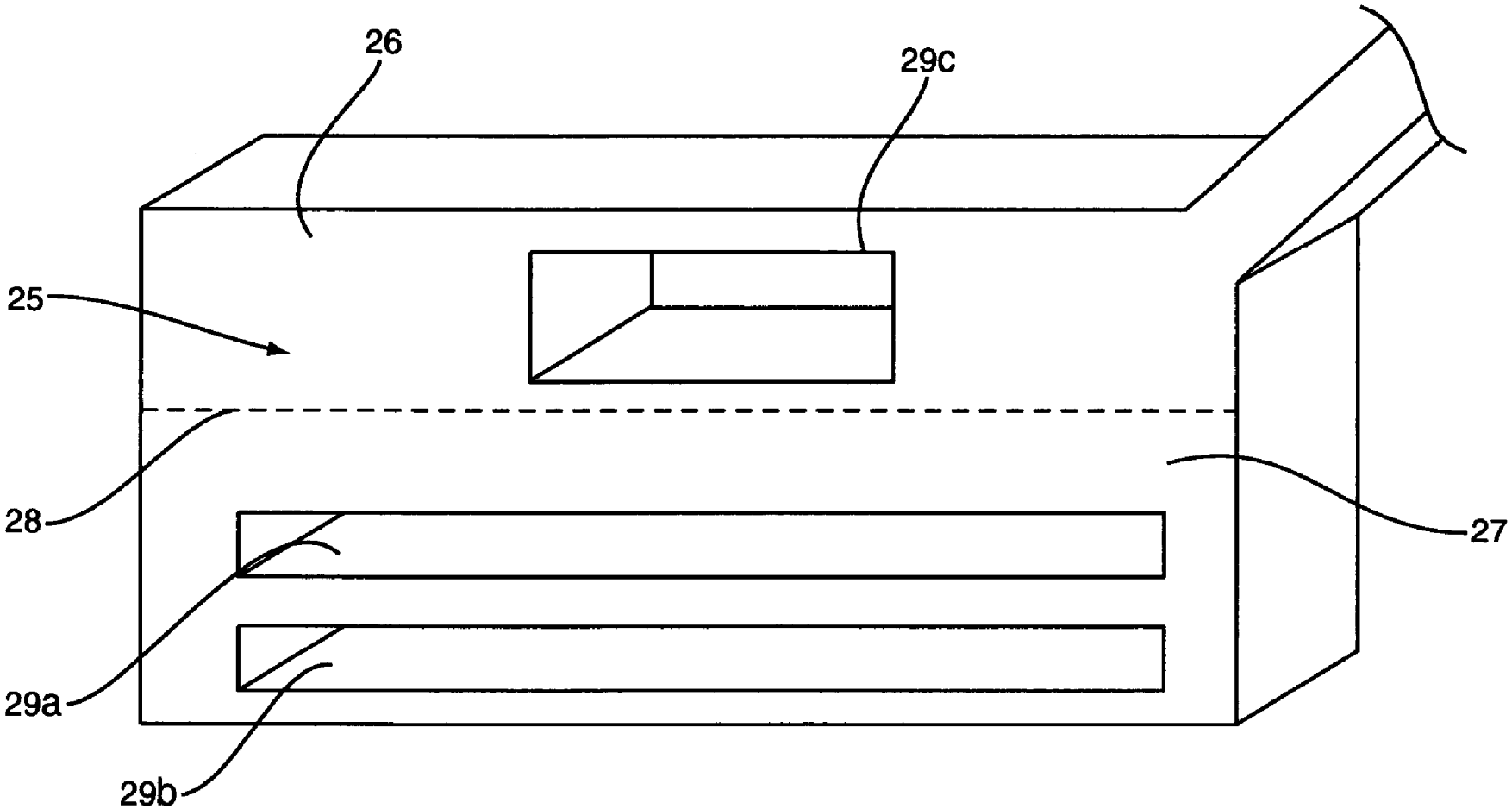
FIG. 4 is a partial perspective view of a trigger section having different opening patterns forming a differentiating characteristic according to another embodiment of the present invention.

FIG. 4 illustrates another embodiment of the trigger section 25 having different opening patterns. The first section 26 features a single opening 29*c*, and the second section 27 features a pair of openings 29*a*, 29*b*. The opening patterns allow for differentiating movement of the arm between the first and second positions, and the first and third positions. The opening 29 may have a variety of different shapes and sizes depending upon the type of sensor 30. Openings 29 may be completely contained within the arm 20 as illustrated in FIGS. 2 and 4, or may be positioned along an edge of the arm forming an indent along the edge of the arm 20. The reference line 28 may be positioned at a variety of locations, including along a centerline of the trigger section, offset from the centerline, or at a variety of positions along the arm 20.

In the embodiments illustrated in FIGS. 2 and 4, the first position 70 features the arm 20 at a position to block the sensor 30 resulting in a low output. Another embodiment features the arm 20 at the first position such that the sensor 30 is not blocked resulting in a high output.

The arm 20 returns to the first position 70 once an event terminates. The arm 20 may bounce when returning to the first position at the end of the event. This includes the arm swinging back-and-forth in a pendulum motion through the first position 70 until finally coming to rest. The controller 60 includes logic to account for the bounce. In one embodiment, logic assumes a time sequence of about 50 milliseconds for the arm 20 to resonate and come to rest at the first position 70. Dampening may also be included to reduce or eliminate the amount of bounce in the arm 20. In one embodiment, the reference line 28 is positioned away from any openings 29 such that when the bounce occurs no openings 29 move within the light beam (i.e., the light beam is blocked by the trigger section 25 during the entire length of the bouncing).

Figure 5:
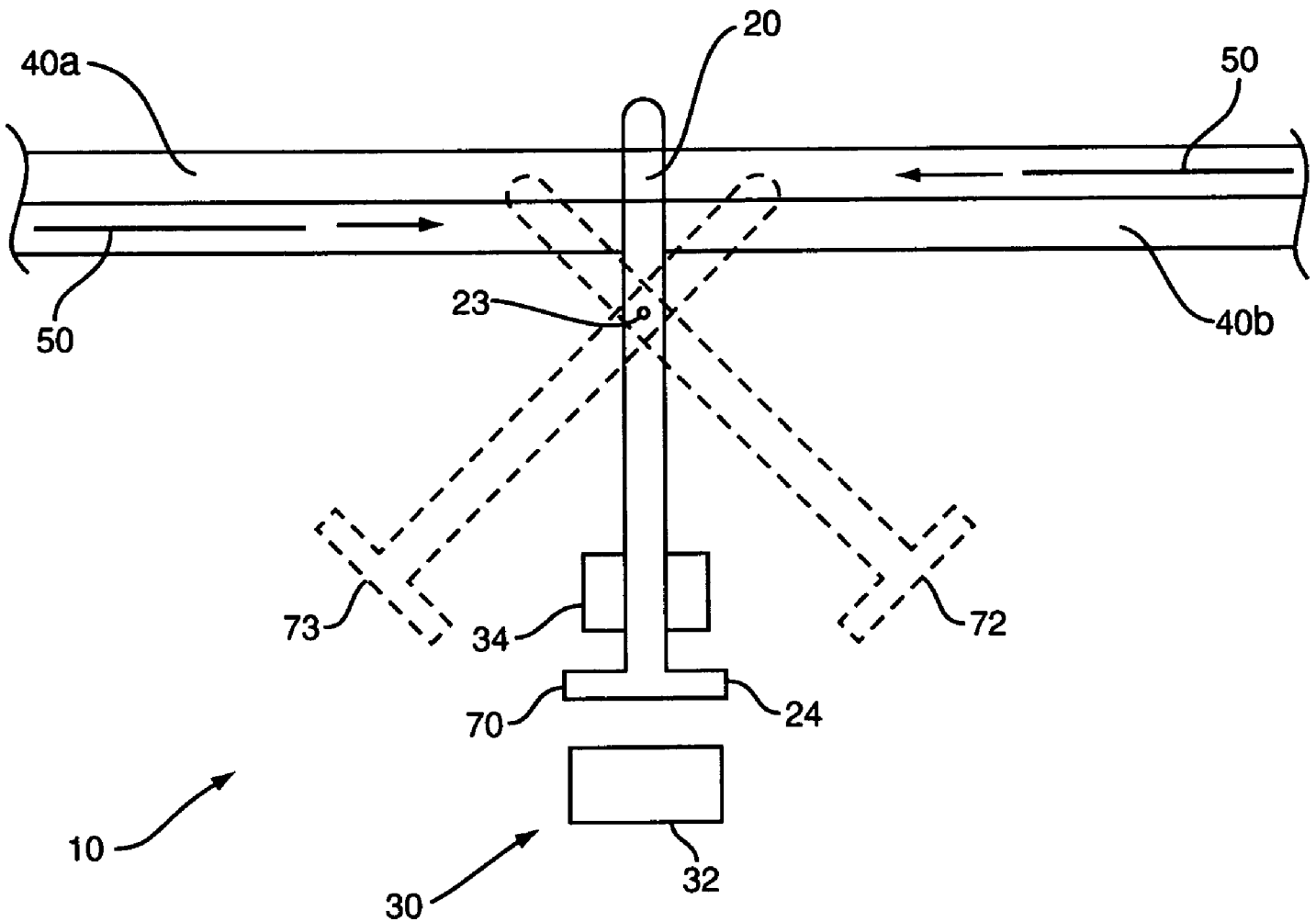
FIG. 5 is a side view of another embodiment of the moving arm positioned adjacent to first and second media paths according to one embodiment of the present invention.

FIG. 5 illustrates another embodiment of the arm 20 positioned adjacent to two media paths. A first event occurs when a media sheet moves in a first direction along a first media path 40*a*. The media sheet contacts the arm 20 moving it from the first position 70 to the second position 72. The arm 20 returns from the second position 72 to the first position 70 after the trailing edge of the media sheet moves beyond the arm 20. A second event occurs when a media sheet moves in a second direction along a second media path 40*b*. The media sheet contacts the arm 20 moving it to the third position 73 until the trailing edge clears at which time it returns.

Figure 6A:
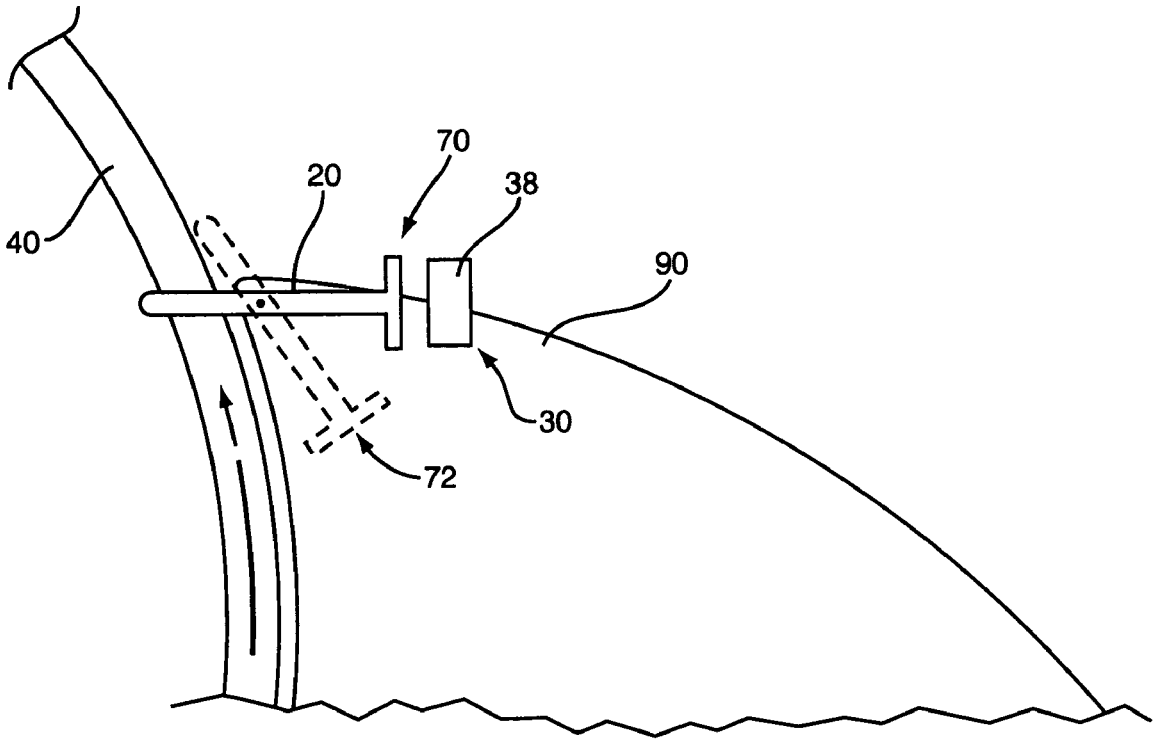
FIG. 6A is a partial side view of a door in a closed orientation and the arm moving between first and second positions according to one embodiment of the present invention.
Figure 6B:
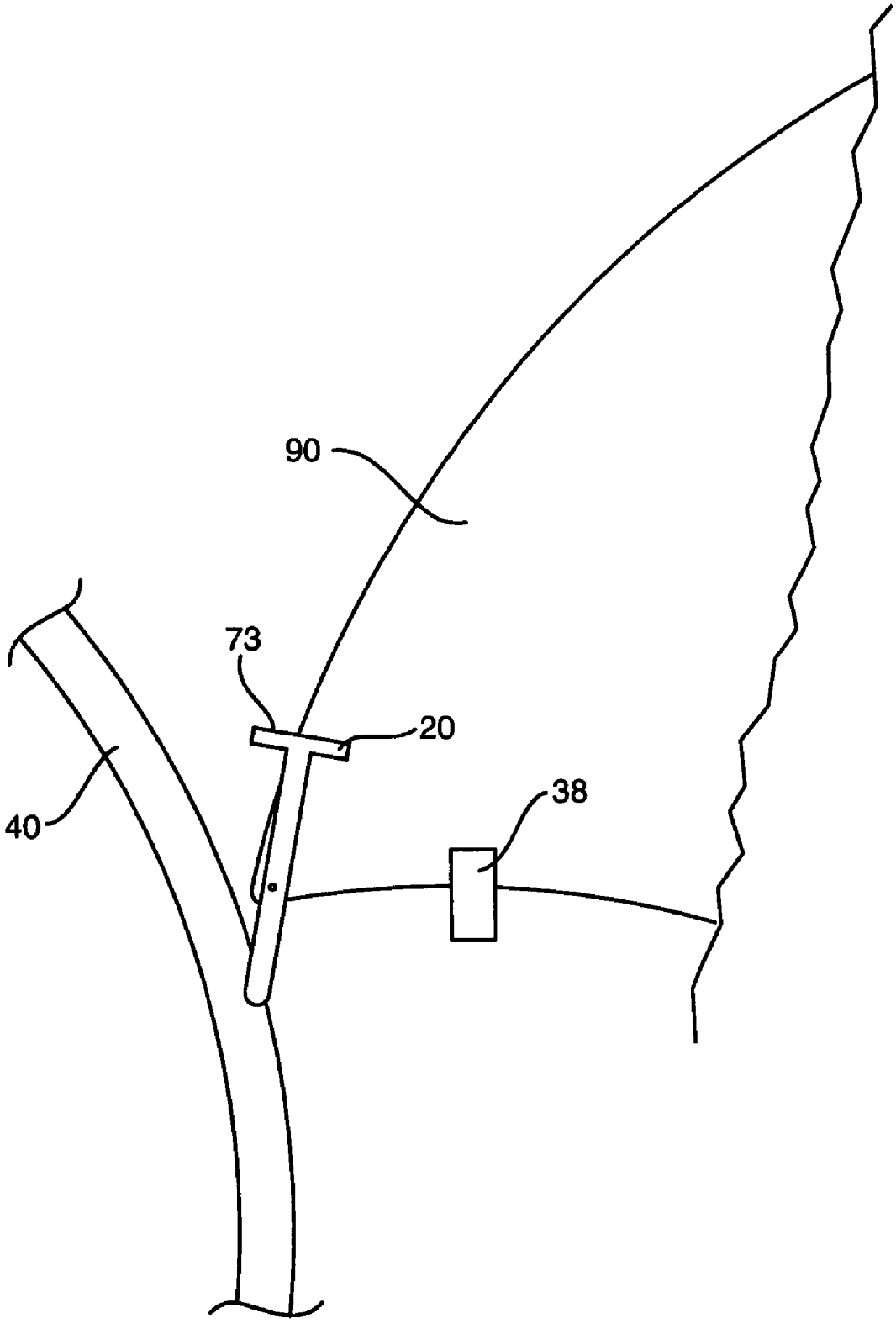
FIG. 6B is a partial side view of the door in an open orientation and the arm moving between first and third positions according to one embodiment of the present invention.

A variety of different events may cause the arm to move from the first position 70. Events may include media sheets moving along a media path 40 as previously defined. Another event is illustrated in FIGS. 6A and 6B which include the movement of a door 90. FIG. 6A illustrates the door 90 in a closed orientation. A first event occurs when a media sheet moves along the media path 40 and moves the arm 20 from the first position 70 to a second position 72. The arm 20 movement from the first position is detected by the sensor 38. A second event includes the door 90 moving between closed and open orientations as illustrated in FIG. 6B. When the door is opened, the arm 20 moves relative to the sensor 38. This movement is opposite to that caused by the first event, and is again detected by the sensor 38. The movement caused by the first event is differentiated from the second event because of the different directions of arm movement (i.e., the first event causes clockwise arm movement, and the second event causes counter-clockwise arm movement). One embodiment of a detector arm positioned to detect movement of media sheets along a media path and the orientation of a door is disclosed in co-pending U.S. patent application Ser. No. 10/639,358 entitled "Sensor and Diverter Mechanism for an Image Forming Apparatus", also assigned to Lexmark International, Inc. and filed on the same day as the present application, and incorporated herein by reference in its entirety. Various other events may also cause arm 20 movement that can be detected and differentiated.

Sensor 30 is positioned to detect movement of the arm 20. The sensor 30 may be positioned to detect the movement of the second end 24, first end 22, or some position therebetween. Various types of sensors 30 may be used to detect movement of the arm 20. In one embodiment, a transmission sensor is used for detecting the characteristics. A transmission sensor transfers a signal from one location to another by means of light, radio, or infrared beams, or other like communication signals. In one embodiment, sensor 30 includes a transmitter 32 that transmits a light beam that is received by receiver 34. One type of light beam sensor is Model No. OJ6202XXX manufactured by Aleph International. Another embodiment features a proximity sensor that produces a signal when approached by an object. FIGS. 6A and 6B illustrate a proximity sensor 38 that detects movement of the arm 20. Sensors may use a variety of techniques to determine the characteristics including transmission sensing, reflectance sensing, capacitance sensing, inductance sensing, and magnetically-based sensing. Each type of sensor 30 requires that the arm 20 have distinguishable characteristics in the first and second sections to determine the event type.

Controller 60 receives the signals from the sensor 30 to monitor the image forming device. In one embodiment, controller 60 includes a microprocessor, random access memory, read only memory, and in input/output interface. One type of controller available for use is found in Model No. C750 available from Lexmark International, Inc. of Lexington Ky.

The term "image forming device" and the like is used generally herein as a device that produces images on a media sheet 50. Examples include but are not limited to a laser printer, ink-jet printer, fax machine, copier, and a multifunctional machine. One example of an image forming device is Model No. C750 referenced above.

In one embodiment, the reference line 28 may be between the transmitter 32 and receiver 34 when the arm 20 is in the first position 70. In another embodiment, the reference line 28 may extend across a solid section of the trigger section 25 such that the sensor 30 is blocked, or may extend across an opening 29 such that the sensor 30 is not blocked.

A variety of different sensed characteristics may be included within the arm 20. The characteristics may include an opening pattern, magnetic pattern, inductance pattern, capacitance pattern, reflective surface, and thickness of the arm 20 among others.

The present invention may be carried out in other specific ways than those herein set forth without departing from the scope and essential characteristics of the invention. In one embodiment, the sensed first and second sections do not completely clear beyond the sensor 30. The distinguishable characteristics in the sections move past the sensor, but less than the entire section moves beyond the sensor 30. In one embodiment, the arm 20 assumes a position other than the first position when no events are occurring. In various embodiments, the triggering section 25 may be positioned at a variety of locations along the arm 20 other than at the second end. Additionally, there may be no triggering section 25 but rather the arm itself that is sensed. 12. In one embodiment, the first characteristic is measured as a first time signal, and the second characteristic is measured as a second time signal, with the first time signal being different than the second time signal. The present embodiments are, therefore, to be considered in all respects as illustrative and not restrictive, and all changes coming within the meaning and equivalency range of the appended claims are intended to be embraced therein.

What is claimed is:

1. A device to detect movement of media sheets along a media path comprising:

an arm pivotally mounted adjacent to the media path and extending into the media path in a first position, the arm comprising a sensed section and a pivot positioned between a first end and a second end;

a sensor positioned adjacent to the arm to detect movement of the arm; and an opening in the sensed section at a location offset from a reference line of the sensed section;

the sensor detecting between movement of the arm in a first direction to a first side of the first position and a second direction to a second side of the first position based on the opening in the sensed section.

2. The device of claim 1, wherein the opening extends parallel with the reference line of the sensed section.

3. The device of claim 2, wherein the reference line is a center line of the sensed section.

4. The device of claim 1, wherein the sensor is a transmission sensor comprising an emitter and a receiver positioned a distance apart between which the sensed section passes.

5. The device of claim 1, wherein the sensor is a proximity sensor near which the sensed section passes.

6. The device of claim 1, further comprising a controller operatively connected to the sensor to differentiate between a first portion of the sensed section moving past the sensor and a second portion of the sensed section moving past the sensor.

7. A device to detect the movement of media sheets along a media path comprising:

an arm pivotable in first and second directions each away from a home position in response to media moving along the media path, the arm comprising a first section having a first characteristic and a second section having a second characteristic, with the first characteristic and the second characteristic being unequal; and a sensor positioned adjacent to the arm to detect movement of the arm in the first direction by sensing the first characteristic, and detecting movement of the arm in the second direction by sensing the second characteristic.

8. The device of claim 7, wherein the first and second characteristics are selected from the group consisting of opening pattern, magnetic pattern, inductance pattern, capacitance pattern, and reflective pattern.

9. The device of claim 7, wherein the arm has an elongated configuration with a first end extending into the media path, and a second end comprising the first section and the second section positioned adjacent to the sensor.

10. The device of claim 7, wherein the first section comprises a first opening pattern and the second section comprises a second opening pattern different than the first opening pattern, and the sensor includes a light beam.

11. The device of claim 7, wherein the first section comprises a first opening pattern with at least one opening and the second section is solid.

12. The device of claim 7, wherein the first characteristic is measured as a first time signal, and the second characteristic is measured as a second time signal, the first time signal being different than the second time signal.

13. A device to detect operating conditions within an image forming device comprising:

an arm pivotable between first, second, and third positions, the arm assuming the second position in response to a first operating event, assuming the third position in response to a second operating event, and assuming the first position in the absence of either the first or second operating events;

a sensor proximate the arm operative to distinguish between the arm moving towards the second position from the first position and the arm moving towards the third position from the first position.

14. The device of claim 13, further comprising an opening within the arm sensed by the sensor when the arm moves towards the second position from the first position.

15. A device to detect operating conditions within an image forming device comprising:

an arm pivotable between first, second, and third positions, the arm assuming the second position in response to a first operating event and assuming the third position in response to a second operating event;

a sensor proximate the arm and generating a first signal in response to the arm moving between the first position and the second position, and generating a second signal in response to the arm moving between the first position and the third position.

16. A device to detect operating conditions within an image forming device comprising:

an arm having a reference line, a first section adjacent to a first side of the reference line, and a second section adjacent to a second side of the reference line, the first section having a first sensed characteristic and the second section having a second sensed characteristic;

a sensor to detect the arm, the sensor being aligned with the reference line during a first operating condition, aligned to detect the first sensed characteristic at a first event, and aligned to detect the second sensed characteristic at a second event.

17. The device of claim 16, further comprising a controller to receive signals from the sensor indicating the first operating condition, the first event, and the second event.

18. A method of detecting media sheets within an image forming device, the method comprising the steps of:

positioning an arm in a first position to extend into a media path;

moving a first media sheet along the media path in a first direction and pivoting the arm from the first position to a second position;

moving a second media sheet along the media path in a second direction and pivoting the arm from the first position to a third position; and differentiating between the arm moving from the first position to the second position and the arm moving from the first position to the third position by sensing an unequal distribution on a sensed section of the arm.

19. A method of detecting operating conditions within an image forming device, the method comprising the steps of:

moving an arm from a first position to a second position and moving a first portion of a sensed section of the arm past a sensor;

moving the arm from the first position to a third position and moving a second portion of the sensed section of the arm past the sensor, the second portion having a sensed characteristic that is different than the first portion; and differentiating the movement of the arm based on the sensed characteristic.

20. A method of detecting operating conditions within an image forming device, the method comprising the steps of:

positioning an arm at a home position with a reference line aligning with a sensor;

moving the arm from the home position to a first position during a first event and sensing a first characteristic of the arm;

moving the arm from the home position to a second position during a second event and sensing a second characteristic of the arm; and differentiating between the first event and the second event by analyzing the first characteristic and the second characteristic.

21. The method of claim 20, wherein the step of moving the arm from the home position to the first position during a first event and sensing a first characteristic of the arm further comprises sensing an opening within the arm moving past the sensor.

22. The method of claim 21, wherein the step of moving the arm from the home position to the second position during the second event and sensing a second characteristic of the arm further comprises sensing a solid face of the arm.

* * * * *